US012134942B2

(12) United States Patent
Breaux et al.

(10) Patent No.: US 12,134,942 B2
(45) Date of Patent: Nov. 5, 2024

(54) CONTROL OF TUBULAR CONNECTIONS BASED ON ESTIMATION OF TURNS REMAINING

(71) Applicant: Baker Hughes Oilfield Operations LLC, Houston, TX (US)

(72) Inventors: Joseph Pierre Breaux, Tomball, TX (US); Dong Liu, Katy, TX (US)

( * ) Notice: Subject to any disclaimer, the term of this patent is extended or adjusted under 35 U.S.C. 154(b) by 12 days.

(21) Appl. No.: 18/182,119

(22) Filed: Mar. 10, 2023

(65) Prior Publication Data

US 2024/0301756 A1 Sep. 12, 2024

(51) Int. Cl.
*E21B 19/16* (2006.01)

(52) U.S. Cl.
CPC ..... *E21B 19/166* (2013.01)

(58) Field of Classification Search
CPC ..... E21B 19/166; E21B 17/02; E21B 17/04; E21B 17/042
See application file for complete search history.

(56) References Cited

U.S. PATENT DOCUMENTS

| | | | |
|---|---|---|---|
| 6,896,055 | B2 | 5/2005 | Koithan |
| 7,100,698 | B2 | 9/2006 | Kracik et al. |
| 7,114,235 | B2 | 10/2006 | Jansch et al. |
| 7,264,050 | B2 | 9/2007 | Koithan et al. |
| 7,519,475 | B2 | 4/2009 | Newman |
| 7,519,508 | B2 | 4/2009 | Newman |
| 7,757,759 | B2 | 7/2010 | Jahn et al. |
| 8,047,283 | B2 | 11/2011 | Jahn et al. |
| 8,074,537 | B2 | 12/2011 | Hunter |
| 8,251,151 | B2 | 8/2012 | Haugen |
| 8,281,856 | B2 | 10/2012 | Jahn et al. |
| 8,297,347 | B2 | 10/2012 | Ruark et al. |

(Continued)

FOREIGN PATENT DOCUMENTS

| | | | | |
|---|---|---|---|---|
| EP | 3473799 A1 | | 4/2019 | |
| JP | 06221475 A | * | 8/1994 | ..... F16L 15/00 |

(Continued)

OTHER PUBLICATIONS

Machine Translation of JP 06221475 (Year: 1994).*

(Continued)

*Primary Examiner* — Aaron L Lembo
(74) *Attorney, Agent, or Firm* — Baker Hughes Company

(57) ABSTRACT

A method of connecting tubular components includes positioning a first tubular component at a surface location and a second tubular component at least partially disposed in a borehole to initiate a threaded connection, and rotating the first tubular component relative to the second tubular component by a tubular connection system, and during the rotating, measuring at least one of a rotational position of the first tubular component and/or a component of the tubular connection system, relative to the second tubular component, and a rotational speed of the first tubular component and/or the component of the tubular connection system. The method further includes measuring a torque, estimating a number of turns remaining to reach a target torque on the first tubular component, and controlling a rotational speed of the first tubular component based on the estimated number of turns remaining to connect the first tubular component to the second tubular component.

20 Claims, 4 Drawing Sheets

(56) References Cited

U.S. PATENT DOCUMENTS

| | | | | |
|---|---|---|---|---|
| 8,490,520 | B2 | 7/2013 | Hunter | |
| 8,590,401 | B2 | 11/2013 | Conquergood et al. | |
| 8,689,866 | B2 | 4/2014 | Patterson et al. | |
| 8,726,743 | B2 | 5/2014 | Ruehmann et al. | |
| 8,899,319 | B2 | 12/2014 | Patterson et al. | |
| 9,027,416 | B2 | 5/2015 | Conquergood et al. | |
| 9,097,070 | B2 | 8/2015 | Hunter | |
| 9,404,324 | B2 | 8/2016 | Hunter | |
| 9,453,377 | B2 | 9/2016 | Mosing et al. | |
| 10,006,260 | B2 | 6/2018 | Webre et al. | |
| 10,100,590 | B2 | 10/2018 | Clostio, Jr. et al. | |
| 10,337,262 | B2 | 7/2019 | Clostio, Jr. et al. | |
| 10,422,450 | B2 | 9/2019 | Ruehmann et al. | |
| 10,436,658 | B2 | 10/2019 | Ruehmann et al. | |
| 10,465,458 | B2 | 11/2019 | Ruehmann et al. | |
| 10,472,906 | B2 | 11/2019 | Zimbelmann et al. | |
| 10,480,291 | B2 | 11/2019 | Wiedecke et al. | |
| 10,538,976 | B2 | 1/2020 | Scekic et al. | |
| 10,605,016 | B2 | 3/2020 | Thiemann | |
| 10,711,543 | B2 | 7/2020 | Ruehmann et al. | |
| 10,760,987 | B2 | 9/2020 | Ruehmann et al. | |
| 10,808,472 | B2 | 10/2020 | Helms et al. | |
| 10,808,474 | B2 | 10/2020 | Ruehmann et al. | |
| 11,255,142 | B2 * | 2/2022 | Taubner | E21B 19/166 |
| 2005/0077084 | A1 * | 4/2005 | Kracik | E21B 19/166 175/24 |
| 2009/0126536 | A1 | 5/2009 | Begnaud et al. | |
| 2014/0174731 | A1 | 6/2014 | Conquergood et al. | |
| 2015/0021016 | A1 * | 1/2015 | Deng | H04B 5/79 166/250.01 |
| 2019/0119997 | A1 | 4/2019 | Helms et al. | |
| 2019/0309878 | A1 | 10/2019 | Ruehmann et al. | |
| 2019/0368286 | A1 * | 12/2019 | Jorud | E21B 47/26 |
| 2020/0024931 | A1 | 1/2020 | Wiedecke et al. | |
| 2020/0047336 | A1 | 2/2020 | Savini et al. | |
| 2020/0063507 | A1 | 2/2020 | Thiemann | |
| 2020/0063509 | A1 | 2/2020 | Rothe et al. | |
| 2020/0199952 | A1 | 6/2020 | Helms et al. | |
| 2020/0256136 | A1 | 8/2020 | Miller et al. | |
| 2020/0291751 | A1 | 9/2020 | Wiedecke et al. | |
| 2020/0318474 | A1 | 10/2020 | Sonnier et al. | |
| 2022/0326678 | A1 * | 10/2022 | Sachtleben | E21B 19/166 |

FOREIGN PATENT DOCUMENTS

| | | | | |
|---|---|---|---|---|
| WO | 2015061350 | A1 | 4/2015 | |
| WO | WO-2018144752 | A1 * | 8/2018 | E21B 17/042 |
| WO | 2019040325 | A1 | 2/2019 | |
| WO | 2019084188 | A1 | 5/2019 | |
| WO | 2020041336 | A1 | 2/2020 | |
| WO | 2020041353 | A1 | 2/2020 | |
| WO | 2020132610 | A2 | 6/2020 | |
| WO | 2020198837 | A1 | 10/2020 | |

OTHER PUBLICATIONS

Notification of Transmittal of the International Search Report and the Written Opinion of the International Searching Authority, or the Declaration; PCT/US2024/012370; Mail Date: May 27, 2024; 9 pages.

* cited by examiner

CONTROL OF TUBULAR CONNECTIONS BASED ON ESTIMATION OF TURNS REMAINING

BACKGROUND

In the resource recovery industry and fluid sequestration industry, various devices, structures and components are deployed into subterranean regions. For example, as a borehole is drilled and/or as borehole string is deployed in a borehole, various tubulars are joined at a surface location, such as a drill rig or platform. Multiple tubulars are joined together, typically by box-pin connections.

An example of a joining system includes a tong system having a backup tong (also referred to as a "backup") and a power tong. When adding a tubular at a rig or other support structure, the backup grips the first tubular and the power tong grips the second tubular. The backup prevents rotation of the first tubular as the power tong rotates the second tubular to connect the pin end with the box end forming a made up connection. The joining system may include one or more sensors to determine whether a properly made up connection is formed between the first and second tubulars. An improper made up connection could require removal and replacement of the tubular, resulting in a significant delay and cost.

SUMMARY

An embodiment of a method of connecting tubular components includes positioning a first tubular component at a surface location and engaging the first tubular component with a tubular connection system and a second tubular component to initiate a threaded connection, the second tubular component at least partially disposed in a borehole. The method also includes rotating the first tubular component relative to the second tubular component by the tubular connection system, and during the rotating, measuring at least one of a rotational position of at least one of the first tubular component and a component of the tubular connection system, relative to the second tubular component, and a rotational speed of at least one of the first tubular component and the component of the tubular connection system. The method further includes measuring a torque applied to the first tubular component by the tubular connection system; estimating a number of turns remaining to reach a target torque on the first tubular component, and controlling, by a speed controller coupled to the tubular connection system, a rotational speed of the first tubular component based on the estimated number of turns remaining to connect the first tubular component to the second tubular component.

An embodiment of a system for connecting tubular components includes a tubular connection system configured to form a threaded connection between a first tubular component and a second tubular component by rotating the first tubular component relative to the second tubular component, the second tubular component at least partially disposed in a borehole, and a control system coupled to the tubular connection system. The control system is configured to, during the rotating, measure at least one of a rotational position of at least one of the first tubular component and a component of the tubular connection system, relative to the second tubular component, and a rotational speed of at least one of the first tubular component and the component of the tubular connection system. The control system is also configured to measure a torque applied to the first tubular component by the tubular connection system, estimate a number of turns remaining to reach a target torque on the first tubular component, and control a rotational speed of the first tubular component based on the estimated number of turns remaining to connect the first tubular component to the second tubular component.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Devices, systems and methods are provided for control of tubular connection processes performed by a tubular connection system (e.g., a power tong system). An embodiment of a connection method includes sampling torque information (e.g., measuring current torque at a given sampling time) and turns information (i.e., a total number of turns that have been performed as of the given sampling time). The torque and turns information are used to estimate a number of turns or rotations remaining to achieve a completely made up connection. For example, at each sampling point, a torque value and a turns value (indicating the number of turns performed as of the sampling time) are determined. A linear or polynomial regression, or other analytical or numerical technique, is applied to generate a prediction as to the number of turns remaining.

The method also includes a turn-based adaptive speed control method that may be triggered based on the number of turns remaining and/or based on a proportion of the current torque to a target torque. The turn-based speed control method is performed by a speed controller or other processing device to gradually reduce the rotation speed as a function of the number of turns remaining. The rotation speed may be reduced according to an exponential decay function derived from historical data (e.g., speed, torque and turns data from other connection processes) to reduce the rotational speed until the target torque is reached.

Embodiments described herein present a number of advantages. The embodiments provide for methodologies that achieve precise connections between tubulars, while reducing reliance on human operators.

The embodiments can be used to make up a tubular connection with a much smaller standard deviation in achieved torque as compared to other methods. For example, some existing methods monitor torque and output control signals to a hydraulic shuttle valve, which shunts hydraulic power to a power tong's hydraulic rotation motor. Such methods can be time consuming and may not be reliably consistent, which can cause a variable differential between a target torque and the torque actually achieved. Embodiments address this limitation and prove for increased precision and reduced time requirements as compared to such other methods.

Figure 1:
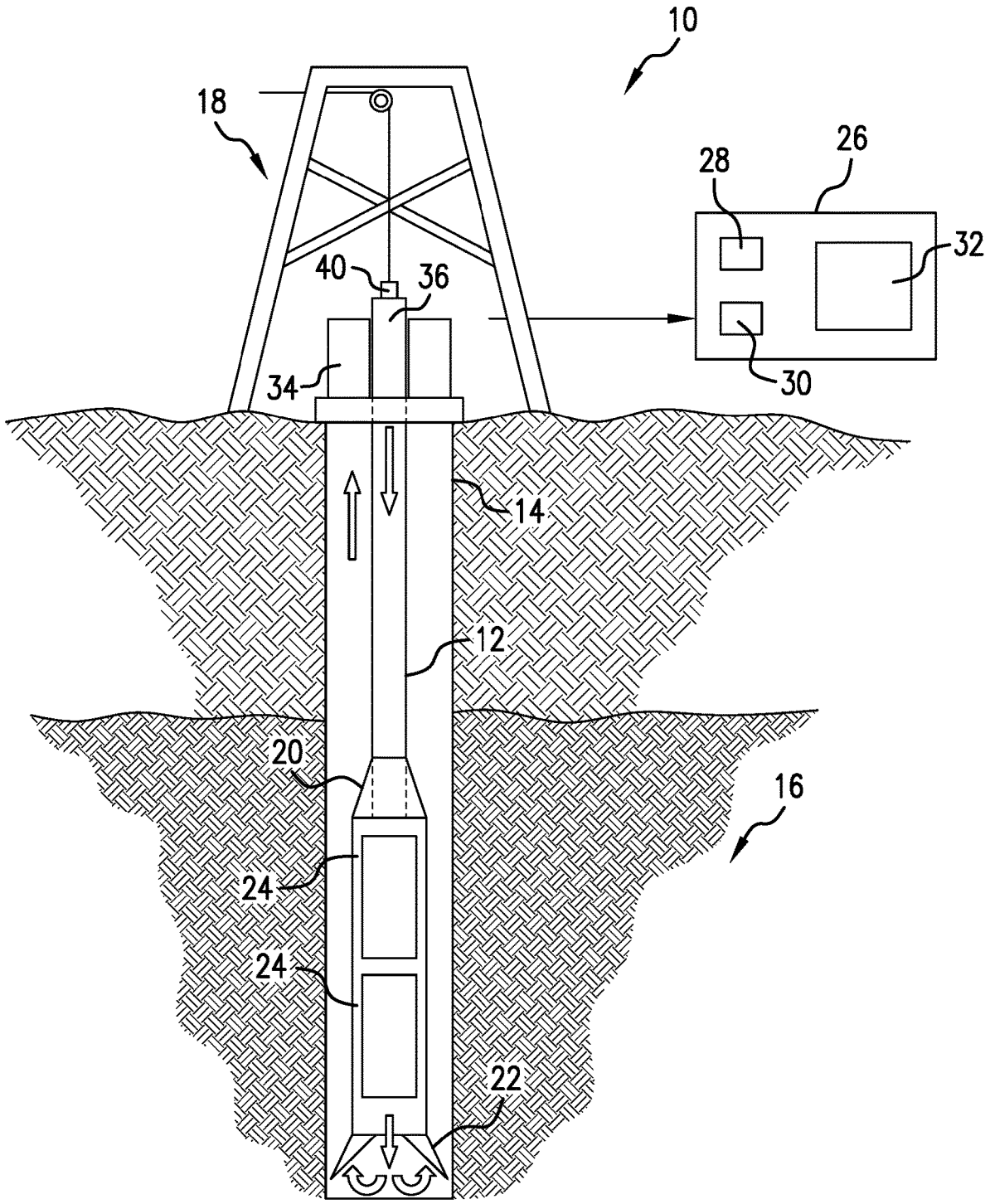
FIG. 1 is a view of a borehole system including a tubular connection system as disclosed herein.

Referring to FIG. 1, an embodiment of a borehole system 10 includes a borehole string 12 disposed in a borehole 14 in a subterranean region that includes, for example, a subsurface formation 16 (e.g., a hydrocarbon bearing formation). The borehole string 12 is operably connected to a surface structure or surface equipment 18, such as a drill rig.

The borehole system 10 can be used to perform various downhole operations, such as drilling, measurement, stimulation, oil and gas production, carbon sequestration, geothermal energy production and others. For example, the borehole string 12 is a drill string that includes one or more tubular components or members connected to a bottomhole assembly (BHA) 20 and a drill bit 22.

The system 10 may include one or more of various tools configured to perform selected functions downhole such as performing downhole measurements and facilitating communications. For example, one or more downhole tools 24 may be included for performing measurements such as logging while drilling (LWD) or measurement while drilling (MWD) measurements.

One or more downhole components and/or one or more surface components may be in communication with and/or controlled by a processing device or system, such as a surface processing unit 26. The surface processing unit 26, in one embodiment, includes an input/output (I/O) device 28, a processor 30, and a data storage device 32 (e.g., memory, computer-readable media, etc.) for storing data, models and/or computer programs or software that cause the processor to perform aspects of methods and processes described herein. As discussed further below, the surface processing unit 26 may be configured to control aspects of connecting tubulars, such as position control (e.g., control of vertical position of components of a tubular connection system), monitoring (e.g., measurements of rotational speed, position and torque), and speed control (e.g., control of rotational speed of a tubular).

The surface equipment 18 includes various components for facilitating drilling, production and/or other operations. For example, the surface equipment 18 includes components such as a surface drive or rotary table, a derrick, and drawworks for lifting and lowering drill pipe and other downhole components.

The surface equipment 18 includes a connection system for joining tubulars (make up) and disconnecting tubulars (break out). The connection system includes a tubular joining system such as a power tong assembly 34. The power tong assembly 34 facilitates connecting and disconnecting tubulars. When adding a tubular to the borehole string 12, the power tong assembly 34 is positioned around an uppermost tubular 36 projecting from the borehole 14, and functions to form a threaded connection of the uppermost tubular 36 to a tubular 38 (shown in FIG. 2) suspended from above. For example, the uppermost tubular 36 includes a box end 40 that forms one portion of the made up threaded connection with a pin end of the tubular 38 (or vice versa).

Figure 2:
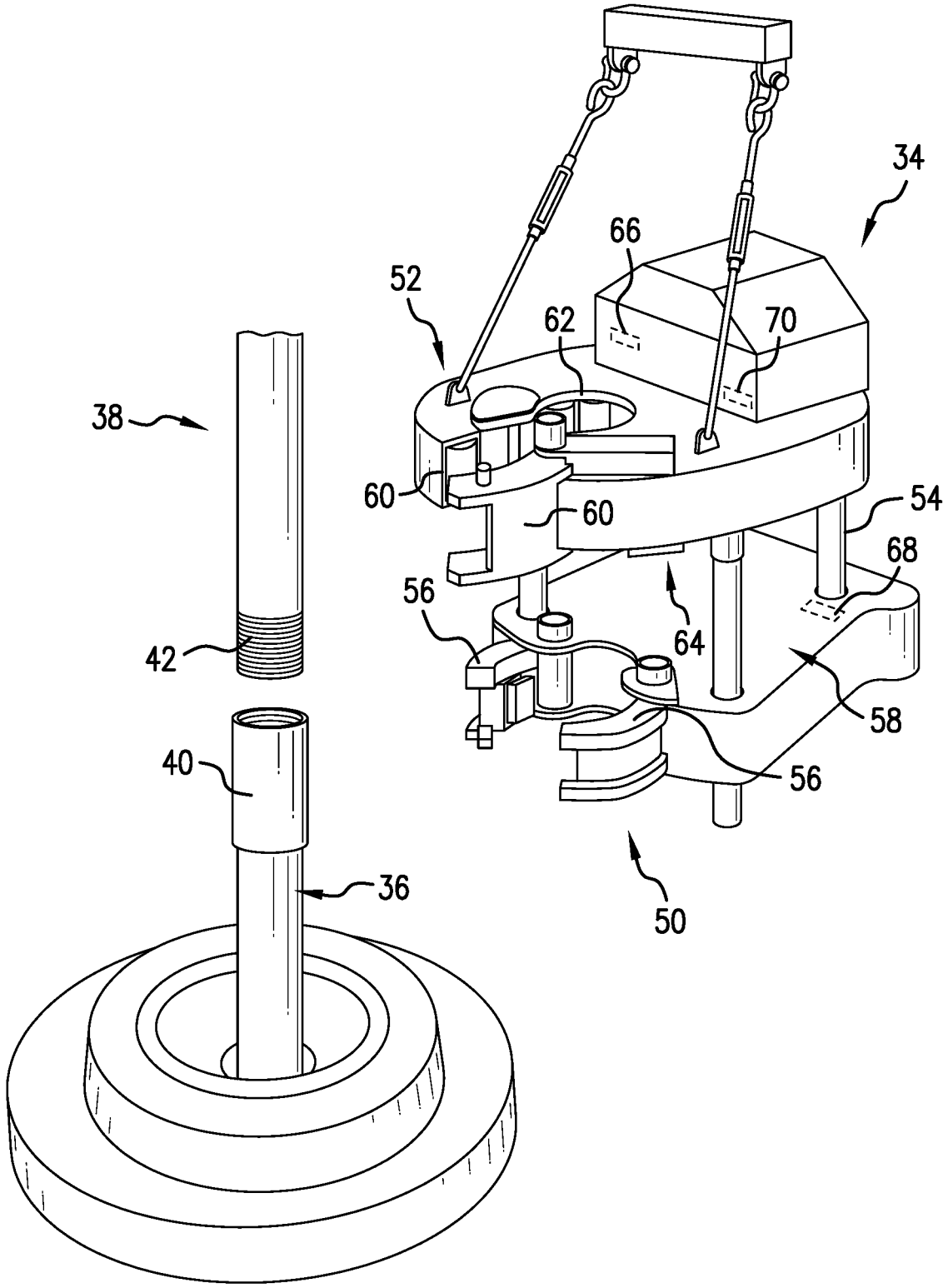
FIG. 2 depicts an embodiment of a tubular connection system including a power tong assembly.

FIG. 2 depicts an embodiment of the power tong assembly 34, which is operable to connect tubulars and other downhole components. For example, the power tong assembly 34 is used to connect the box end 40 of the uppermost tubular 36 and a pin end 42 of the tubular 38. The power tong assembly 34 may be a manually operated system, or a fully automated or partially automated system in which one or more operations of the power tong assembly 34 are controlled by a processing device such as the surface processing unit 26.

In an embodiment, the power tong assembly 34 includes a backup tong 50 or backup 50, which is mechanically linked to a power tong 52 through one or more support members 54. The backup 50 includes a clamping portion having gripping elements 56. Various mechanisms are included in a housing portion 58 for bringing the gripping elements 56 together to grasp the tubular 36, and for separating the gripping elements 56 to release the tubular 36 after, for example, forming a made up connection. Such mechanisms may multiple gears. For example, at least one high gear and at least one low gear (not shown) are located in the power tong assembly 34.

The power tong 52 includes gripping members 60, which are moveable by operating a rotary drive system 62 (e.g., by a speed controller in the surface processing unit 26 or other control system). The rotary drive system 62 rotates the tubular 38 and the pin end 42 into the box end 40 to form a threaded connection.

In an embodiment, the power tong assembly 34 includes or is connected to a monitoring system that operates to monitor a make up process and determine whether a threaded connection has been made up properly, or whether an issue occurred during formation of the threaded connection that results in a poor seal or a poor structural connection. The monitoring system includes one or more processing devices, which may be disposed in the power tong assembly 34 and/or at other location(s), and may be operable to control aspects of a tubular connection process. For example, the monitoring system includes the surface processing system 26 or other processing device that receives data from one or more sensors in the power tong assembly 34, and transmits commands to the power tong assembly 34. In another example, the power tong assembly 34 includes one or more processing devices 64 that perform monitoring and/or control functions (either alone or in conjunction with the surface processing system 26 or other remote processor).

The monitoring system includes or receives data from various sensors and/or sensing systems for monitoring parameters such as rotational position, rotational speed, torque and others. For example, the monitoring system includes or is operatively coupled to a rotary encoder or turns encoder 66 configured to determine a number of turns of the tubular 38 while forming the threaded connection. A load transducer 68 coupled to the housing 58 is configured to sense torque levels associated with forming the threaded connection. Other sensors may include a temperature transducer 70 that monitors temperatures associated with forming the threaded connection.

Figure 3:
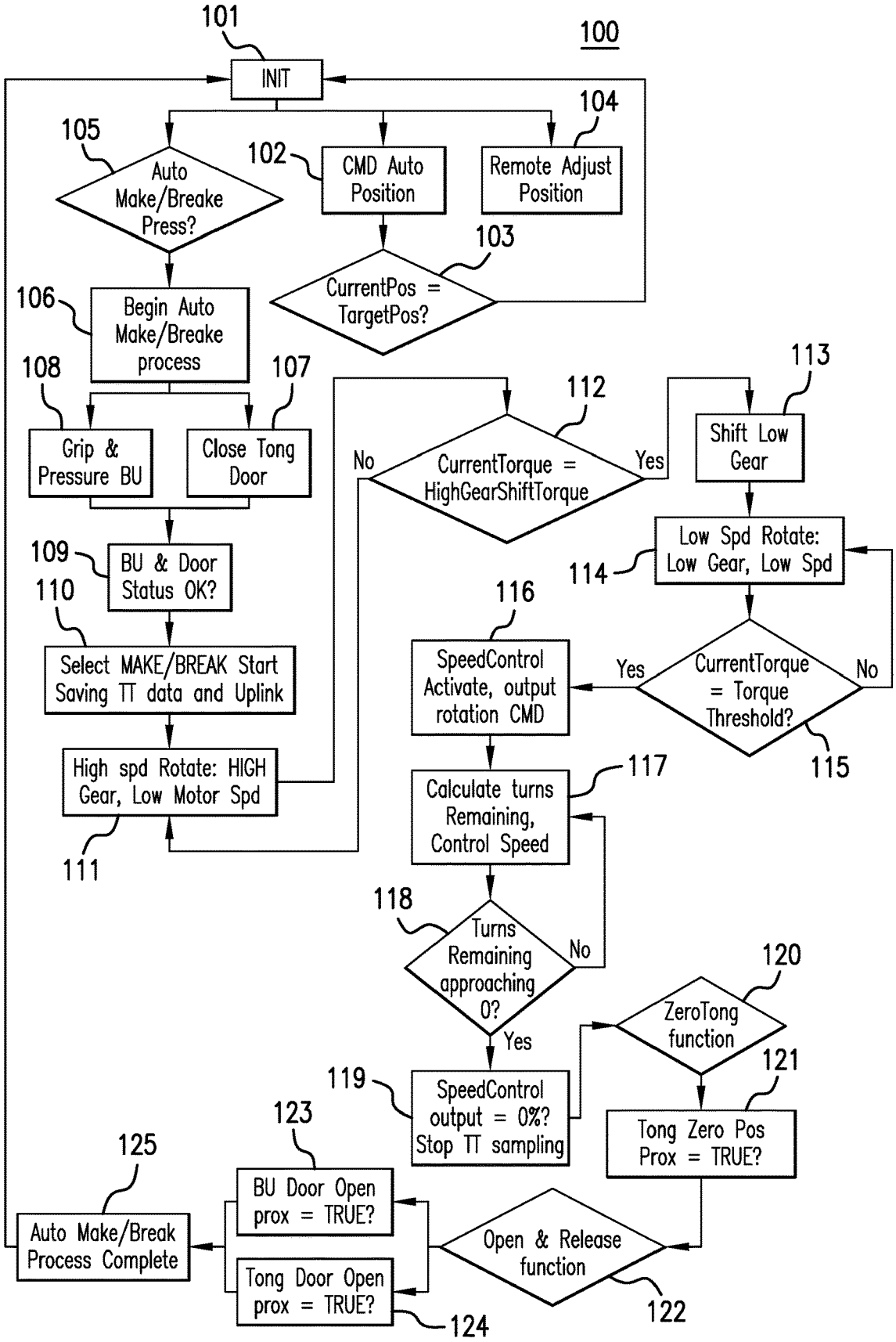
FIG. 3 is a flow diagram depicting an embodiment of a method of forming a connection between tubulars.

FIG. 3 illustrates a method 100 of forming a connection between tubulars. The method 100 includes one or more of stages 101-125 described herein, at least portions of which may be performed by a processor (e.g., the monitoring system, the processing device(s) 64 and/or the surface processing unit 26). In one embodiment, the method 100 includes the execution of all of stages 101-125 in the order described. However, certain stages may be omitted, stages may be added, or the order of the stages changed.

In an embodiment, the method 100 is a real time method that includes sampling or otherwise acquiring sensor measurements, and controlling rotational speed in real time as discussed below.

The method 100 is discussed in conjunction with the power tong assembly 34, the uppermost tubular 36 and the tubular 38 of FIG. 2. However, the method 100 is not so limited and can be used with any suitable tubular connection system and with any suitable downhole components.

At stage 101, the tubular 38 is lowered via drawworks so that the pin end 42 is proximate to the box end 40 of the uppermost tubular 36. Various input parameters are received at a control system (e.g., the surface processing unit 26 or other processor). The input parameters include, for example, tubular properties (e.g., dimensions) torque parameters, power tong door and backup tong door positions, backup clamping pressure, power tong clamping pressure and others.

At stage 102, the tubular 38 is initially engaged with the uppermost tubular 36, and the control system receives a command to automatically position the power tong 52 and positioning device equipment.

At stage 103, the detected position is compared to a target position. If the detected position does not match with the target position, the tubular position is adjusted until the tubular 38 is positioned at the target position (stage 104).

At stage 105, the control system determines whether an automatic make up or break out procedure is requested. If so, the requested procedure commences at stage 106.

At stage 107, the backup tong door and the power tong door are closed. At stage 108, the gripping elements 56 of the backup 50 are brought together and clamp around the tubular 36 with a desired backup tong clamping pressure. The gripping members 60 of the power tong 52 are also brought together and clamp around the tubular 38.

At stage 109, the control system checks the status of the backup tong door and power tong door to ensure that they are closed.

At stage 110, the control system selects the requested mode (i.e., make mode or break mode) and initiates monitoring torque applied to the tubular 38. The control system also initiates monitoring of the rotational position and/or rotational speed of the tubular 38 and/or the power tong 52 (i.e., the power tong rotor position and/or rotor speed), and further initiates monitoring the number of turns. Measurements performed as a result of the monitoring may be stored locally or transmitted for remote monitoring and/or remote control of the make up or break out process.

In an embodiment, the requested mode is the make mode for performing a make up procedure. The following description refers to control of the power tong assembly 34 to make up a connection between the tubulars; however, it is noted that aspects of the method 100 may be performed to disconnect or break out a tubular.

At stage 111, the rotary drive system 62 is engaged at high gear and the rotary drive system rotates the tubular at a high speed (e.g., at a speed greater than about 3.5 RPM, or a percentage of the maximum speed) until a first torque threshold is reached (high gear torque threshold).

During rotation, a torque measurement is acquired (e.g., from the load transducer 68) at each of a plurality of sample times to provide a "current torque" value. In addition, at each sample time, the rotational position or an output from the turns encoder 66 is acquired to provide an estimation of a "current total number of turns," defined as the total number of turns that have been performed as of the sample time. Other values may be acquired or calculated at each sample time, such as rotational speed.

A "turn" refers to an amount of rotation or change in rotational position. A turn may be a 360 degree rotation of the tubular, and can be expressed in terms of full turns (i.e., 360 degree rotations) and fractions of a turn.

At stage 112, the current torque is periodically or continuously (e.g., at each sampling time) compared to the high gear torque threshold. Rotation at the high speed is maintained until the current torque reaches the high gear threshold, i.e., equals the high gear torque threshold or is within a range of the high gear torque threshold.

At stage 113, when the current torque reaches the high gear torque threshold, the tong stops rotation firstly. Then the gearbox is shifted to a low gear and rotation restarts at a lower speed (stage 114). The current torque, current total number of turns and/or rotational speed continues to be monitored.

At stage 115, monitored values are compared to a reference value to determine when to trigger turn-based speed control. In an embodiment, the reference value is a torque value that may be expressed in relation to the target torque. For example, the current torque is compared to a low gear torque threshold, which may be a selected torque value, or be based on a proportion of the desired or target torque. The low gear torque threshold is, for example, a selected proportion of the target torque, such as about 25% of the target torque.

Turn-based speed control may be triggered based on other information. For example, the control system can monitor a number of turns remaining, and trigger turn-based speed control when the number of turns remaining is less than a threshold number (e.g., 0.1 turns remaining). The "number of turns remaining" corresponds to a number of turns that is estimated to be needed to reach the target torque, and may be calculated as discussed below.

At stage 116, when the current torque reaches the low gear torque threshold, the power tong assembly 34 transitions to a turn-based speed control mode, in which the motor speed is gradually reduced based on an estimation of a number of turns remaining.

The turn-based speed control mode provides for a real time control methodology that may be triggered based on the number of turns remaining, or based on a proportion of the current torque to a maximum or target torques. The speed control method is performed by a speed controller or other processing device of the control system to gradually reduce the rotational speed as a function of the number of turns remaining. The rotation speed may be reduced according to a function derived from historical data (e.g., speed, torque and turns data from other connection processes) to reduce the rotational speed until the target torque is reached, or the turns remaining threshold is reached.

At stage 117, the turns remaining is calculated at least during rotation at the lower speed, and the rotational speed is controlled as a function of the number of turns remaining. In an embodiment, the speed is gradually reduced based on the number of turns remaining, i.e., as the number of turns remaining decreases, until the target torque is reached, or the turns remaining threshold is reached.

In an embodiment, the number of turns remaining is calculated by collecting torque and turns information. Including the torque measured at each sampling time and the current number of turns at each sample time. This information is used to generate a torque-turns curve that represents a relationship between torque and the total number of turns. For example, the torque-turns curve is calculated by calculating on a moving average of the torque over a selected duration or number of samples (e.g., 80 samples), as a function of the current total number of turns. The torque-turns curve is analyzed by performing a linear regression or polynomial regression to fit the torque-turns curve to a linear or polynomial function. The fitted curve is then extrapolated to predict the number of turns remaining.

Rotational speed is controlled according to the function derived from the historical data. In an embodiment, the function is an exponential decay function. For example, historical data representing speed as a function of turns is used to determine an exponential decay function. The exponential decay function may be weighted by applying a sequence of weights. The weight calculated for a given set of samples may be based on a difference between the total number of turns already performed and a number of turns performed during the set of samples.

At stage 118, the control system monitors the number of turns remaining and determined when the turns remaining approaches zero (i.e., is within a selected range of zero). As a results of the turns remaining calculation, the target torque should be reached when the turns remaining approaches zero.

At stage 119, when the number of turns remaining approaches zero and the target torque is reached, measurements stop, and rotation is stopped. After rotation is stopped and before calling zero tong function, the power tong 52 is rotated in opposition direction for a short time (e.g., a few seconds) in order to release the torque.

At stage 120, a zero tong function is initiated to determine whether the power tong 52 is in a zero position or the power tong 52 has been commanded to move to the zero position (stage 121). An open and release function is then initiated (stage 122) after a successful zero tong function, in which the power tong 52 and the backup 50 are released from the tubulars, and the tong doors are opened. The system confirms that the backup tong door is open (stage 123), and that the power tong door is open (stage 124). At this point, the make up procedure completes (stage 125). After forming the threaded connection, the borehole string 12 may be advanced downhole. If additional tubulars are to be added, the method 100 is repeated as needed.

Adaptive speed control according to the method 100 provides for a gradual decrease in rotational speed of the power tong to achieve, which can achieve a much more precise torque application as compared to current systems that employ a mixture of electrical computing systems and hydraulic valves. Such current systems are subject to variable physical timings, which can result in inconsistent application of torque. This new method can also reduce the amount of kinetic energy present at the conclusion of a make up procedure, and lengthens the time during which stored energy is dissipated in the system, resulting in a reduction in the potential for damage to threaded connections.

Figure 4:
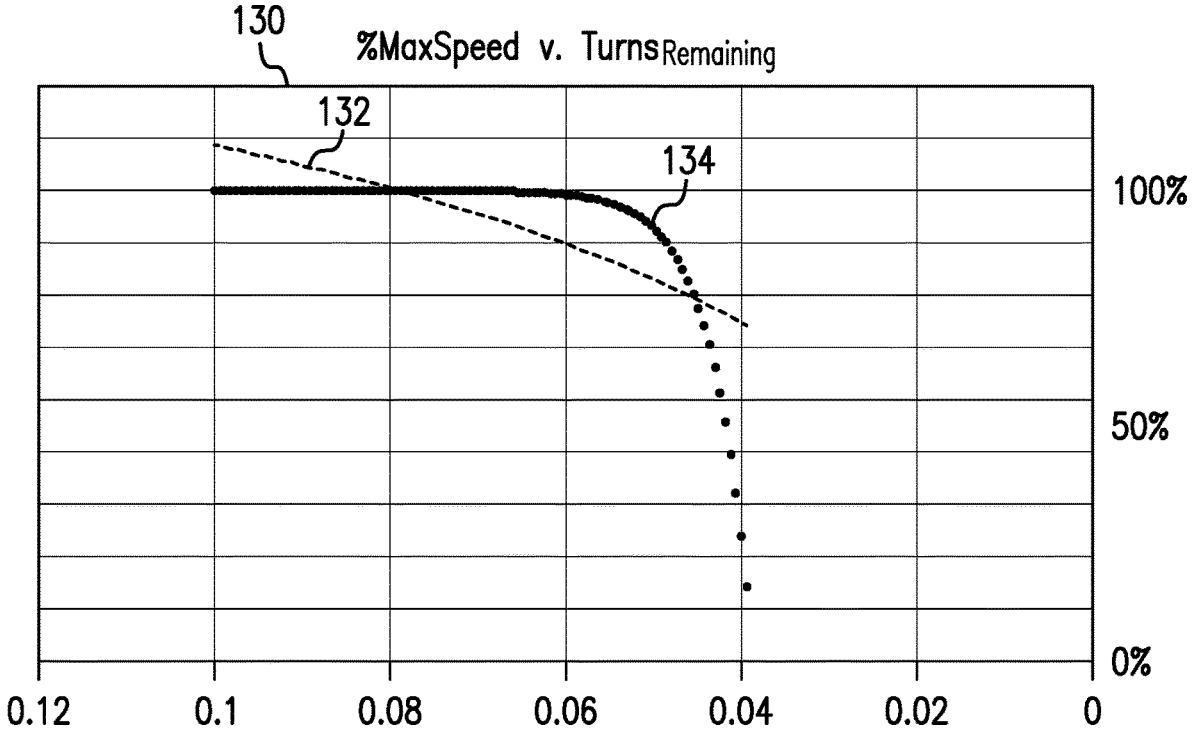
FIG. 4 depicts an example of an estimation of turns remaining and aspects of rotational speed control according to the method of FIG. 3.

FIG. 4 depicts an example of a turns remaining calculations and speed control based on a number of turns remaining. In this example, torque and turns remaining were acquired at each of a plurality of sampling points.

In this example, the number of turns remaining was calculated by generating a torque-turns curve based on historical data. The torque-turns curve was subject to a linear regression using logarithmic transformations. FIG. 4 shows a graph 130 including an example of a torque-turns curve 132.

The number of turns remaining was calculated using the linear regression of historical data points collected, and the number of turns remaining was used to control the rotational speed in real time according to a speed curve 134 that includes speed set points calculated using an exponential decay function.

Set forth below are some embodiments of the foregoing disclosure:

Embodiment 1: A method of connecting tubular components, comprising: positioning a first tubular component at a surface location and engaging the first tubular component with a tubular connection system and a second tubular component to initiate a threaded connection, the second tubular component at least partially disposed in a borehole; rotating the first tubular component relative to the second tubular component by the tubular connection system; during the rotating, measuring at least one of: a rotational position of at least one of the first tubular component and a component of the tubular connection system, relative to the second tubular component, and a rotational speed of at least one of the first tubular component and the component of the tubular connection system; measuring a torque applied to the first tubular component by the tubular connection system; estimating a number of turns remaining to reach a target torque on the first tubular component; and controlling, by a speed controller coupled to the tubular connection system, a rotational speed of the first tubular component based on the estimated number of turns remaining to connect the first tubular component to the second tubular component.

Embodiment 2: The method as in any prior embodiment, further comprising, based on the measured torque reaching the desired torque, disengaging the rotary drive from the first tubular component, and deploying the first tubular component in the borehole.

Embodiment 3: The method as in any prior embodiment, wherein controlling the rotational speed includes gradually reducing the rotational speed as a function of the estimated number of turns remaining.

Embodiment 4: The method as in any prior embodiment, wherein estimating the number of turns remaining includes measuring a current torque at each of a plurality of sample times, measuring a total number of turns at each of the plurality of sample times, and generating a torque-turns curve representing a relationship between an amount of torque applied to the first tubular component and a number of turns performed by the rotating.

Embodiment 5: The method as in any prior embodiment, wherein the number of turns remaining is estimated by fitting the torque-turns curve to a function.

Embodiment 6: The method as in any prior embodiment, wherein fitting the torque-turns curve includes performing a linear regression or a polynomial regression.

Embodiment 7: The method as in any prior embodiment, wherein controlling the rotational speed is initiated based on a ratio of the measured torque to the target torque being greater than a torque ratio threshold.

Embodiment 8: The method as in any prior embodiment, wherein controlling the rotational speed is initiated based on at least one of: the number of turns remaining being less than a threshold number of turns, and a difference between the number of turns remaining and a number of turns already performed by the rotating.

Embodiment 9: The method as in any prior embodiment, wherein controlling the rotational speed is based on collecting historical data from one or more previous tubular connection processes.

Embodiment 10: The method as in any prior embodiment, wherein controlling the rotational speed includes decreasing the rotational speed according to an exponential decay function derived from the historical data.

Embodiment 11: A system for connecting tubular components, comprising: a tubular connection system configured to form a threaded connection between a first tubular component and a second tubular component by rotating the first tubular component relative to the second tubular component, the second tubular component at least partially disposed in a borehole; and a control system coupled to the tubular connection system, the control system configured to: during the rotating, measure at least one of: a rotational position of at least one of the first tubular component and a component of the tubular connection system, relative to the second tubular component, and a rotational speed of at least one of the first tubular component and the component of the tubular connection system; measure a torque applied to the first tubular component by the tubular connection system; estimate a number of turns remaining to reach a target torque on the first tubular component; and control a rotational speed of the first tubular component based on the estimated number of turns remaining to connect the first tubular component to the second tubular component.

Embodiment 12: The system as in any prior embodiment, wherein the control system is configured to, based on the measured torque reaching the target torque, disengage the tubular connection system from the first tubular component.

Embodiment 13: The system as in any prior embodiment, wherein the control system is configured to gradually reduce the rotational speed as a function of the estimated number of turns remaining.

Embodiment 14: The system as in any prior embodiment, wherein the control system is configured to estimate the number of turns remaining by measuring a current torque at each of a plurality of sample times, measuring a total number of turns at each of the plurality of sample times, and generating a torque-turns curve representing a relationship between an amount of torque applied to the first tubular component and a number of turns performed by the rotating, Embodiment 15: The system as in any prior embodiment, wherein the number of turns remaining is estimated by fitting the torque-turns curve to a function.

Embodiment 16: The system as in any prior embodiment, wherein fitting the torque-turns curve includes performing a linear regression or a polynomial regression.

Embodiment 17: The system as in any prior embodiment, wherein the tubular connection system includes a power tong system.

Embodiment 18: The system as in any prior embodiment, wherein the control system is configured to initiate the control of the rotational speed based on a ratio of the measured torque to the target torque being greater than a torque ratio threshold.

Embodiment 19: The system as in any prior embodiment, wherein the control system is configured to initiate the control of the rotational speed based on at least one of: the number of turns remaining being less than a threshold number of turns, and a difference between the number of turns remaining and a number of turns already performed by the rotating.

Embodiment 20: The system as in any prior embodiment, wherein the control system is configured to control the rotational speed of the first tubular component is based on historical data collected from one or more previous tubular connection processes.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value, or other desired range.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of connecting tubular components, comprising:

positioning a first tubular component at a surface location and engaging the first tubular component with a tubular connection system and a second tubular component to initiate a threaded connection, the second tubular component at least partially disposed in a borehole;

rotating the first tubular component relative to the second tubular component by the tubular connection system;

during the rotating, measuring at least one of:

a rotational position of at least one of the first tubular component and a component of the tubular connection system, relative to the second tubular component, and a rotational speed of at least one of the first tubular component and the component of the tubular connection system;

measuring a torque applied to the first tubular component by the tubular connection system;

estimating a number of turns remaining to reach a target torque on the first tubular component; and controlling, by a speed controller coupled to the tubular connection system, a rotational speed of the first tubular component based on the estimated number of turns remaining to connect the first tubular component to the second tubular component, wherein controlling the rotational speed is based on collecting historical data from one or more previous tubular connection processes, and controlling the rotational speed includes decreasing the rotational speed according to an exponential decay function derived from the historical data.

2. The method of claim 1, further comprising, based on the measured torque reaching the desired torque, disengaging the rotary drive from the first tubular component, and deploying the first tubular component in the borehole.

3. The method of claim 1, wherein controlling the rotational speed includes gradually reducing the rotational speed as a function of the estimated number of turns remaining.

4. The method of claim 1, wherein estimating the number of turns remaining includes measuring a current torque at each of a plurality of sample times, measuring a total number of turns at each of the plurality of sample times, and generating a torque-turns curve representing a relationship between an amount of torque applied to the first tubular component and a number of turns performed by the rotating.

5. The method of claim 4, wherein the number of turns remaining is estimated by fitting the torque-turns curve to a function.

6. The method of claim 5, wherein fitting the torque-turns curve includes performing a linear regression or a polynomial regression.

7. The method of claim 1, wherein controlling the rotational speed is initiated based on a ratio of the measured torque to the target torque being greater than a torque ratio threshold.

8. The method of claim 1, wherein controlling the rotational speed is initiated based on at least one of: the number of turns remaining being less than a threshold number of turns, and a difference between the number of turns remaining and a number of turns already performed by the rotating.

9. The method of claim 1, wherein the exponential decay function is weighted by applying a series of weight values to the exponential decay function.

10. The method of claim 9, wherein controlling the rotational speed includes decreasing the rotational speed according to an exponential decay function derived from the historical data claim 4, wherein each weight value of the series of weight values is calculated for a set of measurements at a set of sample times.

11. A system for connecting tubular components, comprising:

a tubular connection system configured to form a threaded connection between a first tubular component and a second tubular component by rotating the first tubular component relative to the second tubular component, the second tubular component at least partially disposed in a borehole; and a control system coupled to the tubular connection system, the control system configured to:

during the rotating, measure at least one of:

a rotational position of at least one of the first tubular component and a component of the tubular connection system, relative to the second tubular component, and a rotational speed of at least one of the first tubular component and the component of the tubular connection system;

measure a torque applied to the first tubular component by the tubular connection system;

estimate a number of turns remaining to reach a target torque on the first tubular component; and control a rotational speed of the first tubular component based on the estimated number of turns remaining to connect the first tubular component to the second tubular component, wherein the rotational speed is controlled based on collecting historical data from one or more previous tubular connection processes, and the rotational speed is controlled by decreasing the rotational speed according to an exponential decay function derived from the historical data.

12. The system of claim 11, wherein the control system is configured to, based on the measured torque reaching the target torque, disengage the tubular connection system from the first tubular component.

13. The system of claim 11, wherein the control system is configured to gradually reduce the rotational speed as a function of the estimated number of turns remaining.

14. The system of claim 11, wherein the control system is configured to estimate the number of turns remaining by measuring a current torque at each of a plurality of sample times, measuring a total number of turns at each of the plurality of sample times, and generating a torque-turns curve representing a relationship between an amount of torque applied to the first tubular component and a number of turns performed by the rotating.

15. The system of claim 14, wherein the number of turns remaining is estimated by fitting the torque-turns curve to a function.

16. The system of claim 15, wherein fitting the torque-turns curve includes performing a linear regression or a polynomial regression.

17. The system of claim 11, wherein the tubular connection system includes a power tong system.

18. The system of claim 11, wherein the control system is configured to initiate the control of the rotational speed based on a ratio of the measured torque to the target torque being greater than a torque ratio threshold.

19. The system of claim 11, wherein the control system is configured to initiate the control of the rotational speed based on at least one of: the number of turns remaining being less than a threshold number of turns, and a difference between the number of turns remaining and a number of turns already performed by the rotating.

20. The system of claim 11, wherein the exponential decay function is weighted by applying a series of weight values to the exponential decay function, each weight value of the series of weight values calculated for a set of measurements at a set of sample times.

* * * * *